United States Patent [19]

Schonherr

[11] 4,097,206

[45] Jun. 27, 1978

[54] GEAR PUMP OR MOTOR WITH BYPASS THROTTLE PASSAGE TO PREVENT CAVITATION

[75] Inventor: Erich Schonherr, Stuttgart, Germany

[73] Assignee: Robert Bosch GmbH, Stuttgart, Germany

[21] Appl. No.: 743,289

[22] Filed: Nov. 18, 1976

[30] Foreign Application Priority Data

Dec. 2, 1975 Germany ..... 2554105

[51] Int. Cl.[2] ..... F01C 19/08; F01C 21/00; F03C 3/00; F01C 1/16

[52] U.S. Cl. ..... 418/78; 418/131; 418/180; 418/189; 418/206

[58] Field of Search ..... 418/15, 78, 79, 131–135, 418/180, 189, 205, 206

[56] References Cited

U.S. PATENT DOCUMENTS

| | | | |
|---|---|---|---|
| 2,981,200 | 4/1961 | Stephens | 418/180 |
| 3,113,524 | 12/1963 | Fulton | 418/206 |
| 3,137,238 | 6/1964 | Gordon | 418/180 |
| 3,474,736 | 10/1969 | Lauck | 418/180 |

*Primary Examiner*—John J. Vrablik
*Attorney, Agent, or Firm*—Michael J. Striker

[57] ABSTRACT

A gear pump or motor in which a pair of meshing gears are rotatably mounted in a housing and in which a throttle passage provides communication between a region of the housing in which, during rotation of the gears, high pressure is maintained and the region of the interstices between engaging teeth of the gears at which these interstices increase during such rotation, to prevent cavitation and to essentially reduce noise during operation.

10 Claims, 9 Drawing Figures

GEAR PUMP OR MOTOR WITH BYPASS THROTTLE PASSAGE TO PREVENT CAVITATION

BACKGROUND OF THE INVENTION

The present invention relates to a gear pump or motor having two interengaging gears rotatably mounted in a housing.

It is known to provide in such gear machines control grooves providing communication between the suction side of the machine and the interstices of engaging teeth of the rotating gears in which these interstices increase in volume while the respective gear teeth move away from each other. This has the disadvantage that the pressure in these interstices will quickly decrease, which in turn will lead to considerable noise during operation of the machine. In addition a high underpressure will be created at unfavorable suction conditions in the increasing interstices between two engaging gear teeth. This will lead to cavitation and increased noise during operation. Such cavitation, in turn, may lead to a quick destruction of the machine.

SUMMARY OF THE INVENTION

It is an object of the present invention to provide a gear machine of the above-mentioned kind which avoids the disadvantages of such gear machines known in the art.

It is a further object of the present invention to provide a gear machine of the aforementioned kind which has a long useful life and which operates without creating undue noise.

These objects are obtained according to the present invention by providing in a wall abutting against the side faces of the gear a throttle passage which provides communication between a region in which during rotation of the gears high pressure is maintained and the region of the interstices between engaging teeth of the gears in which these interstices increase during such rotation.

In this way a certain pressure equalization between the increasing interstices and the high pressure side of the machine is obtained so that formation of under-pressure and cavitation, as well as noise during operation is reduced or completely prevented.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 3:
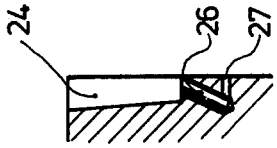
FIG. 3 is a partial cross-sectional taken along the line III—III of FIG. 1.
Figure 1:
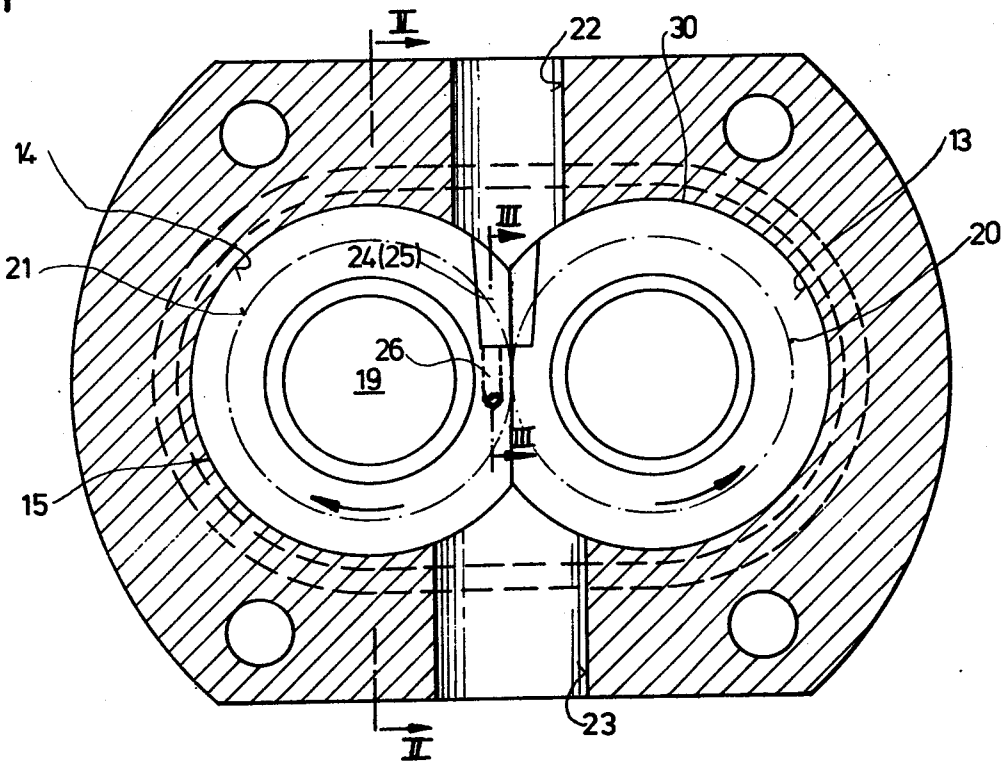
FIG. 1 is a cross-section through a gear pump according to the present invention.
Figure 2:
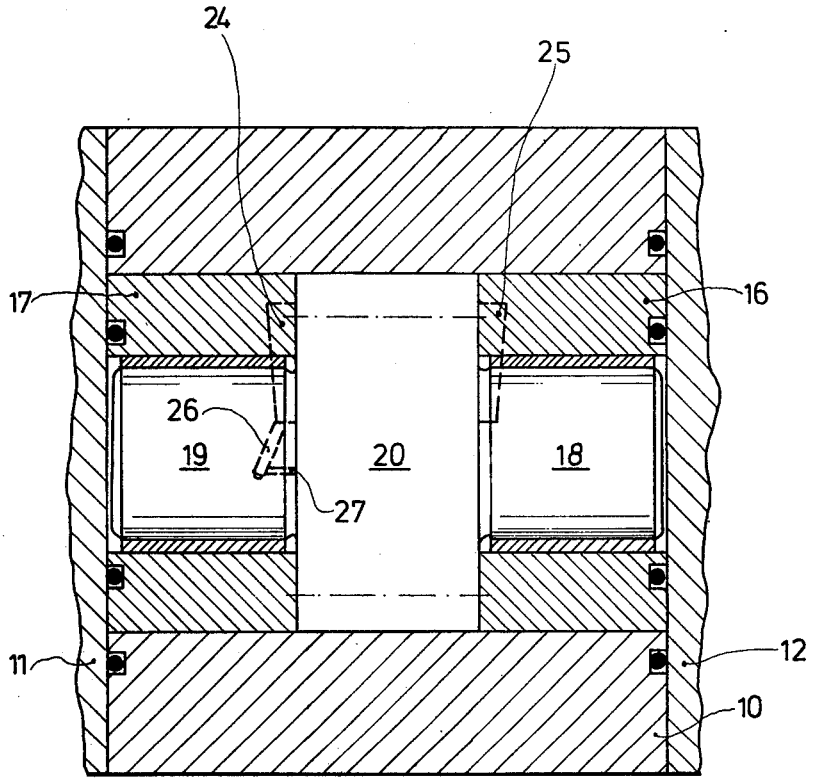
FIG. 2 is a cross-section taken along the line II—II of FIG. 1.
Figure 8:
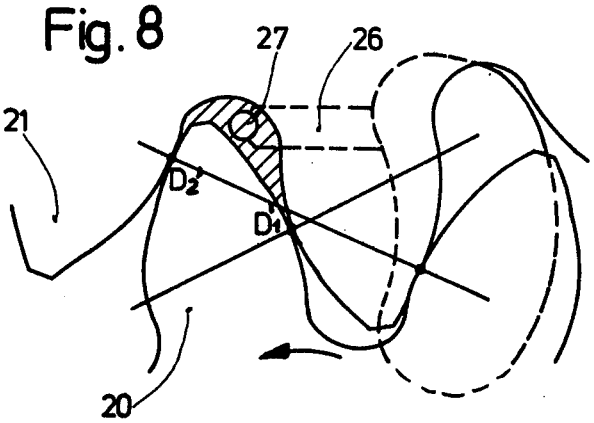

Referring now to the drawing, and more specifically to FIGS. 1–3 of the same, it will be seen that the gear pump according to the present invention may comprise a central housing part 10 formed with two intersecting bores 13 and 14 to provide in the housing part 10 a chamber 15 having a cross-section substantially in the form of a figure 8. The chamber 15 is closed at opposite ends by end walls or covers 11 and 12 which are connected to the central housing part 10 by means not shown in the drawing, for instance by screws. Two bearing bodies 16 and 17 are arranged in the bore 13 of the housing in which the trunions 18 and 19 of an external gear 20 are rotatably mounted. The gear 20 meshes with a likewise external gear 21 which is rotatably mounted in two bearings, similar to the bearings 16 and 17, arranged in the bore 14 and not specifically designated in the drawing. A high pressure bore 22 extends from the outer periphery of the housing 10 into the chamber 15 and opposite and axially aligned with the high pressure bore 22 is a low pressure bore 23 leading from the chamber 15 to the outside of the housing 10.

So-called control grooves 24 and 25 are formed at the side faces of the bearing bodies 16 and 17 which are directed toward the side faces of the gears 21 and 22 and these control grooves 24 and 25 are in communication with the high pressure bore 22 and extend from the latter in the direction of the plane at which the two bearing bodies 16 and 17 engage each other toward, but short of, a plane which includes the axes of the trunions of the gears. A bore 26 extends, from the end of the control groove 24 distant from the high pressure bore 22, into the bearing body 17, substantially parallel to the aforementioned engaging plane, toward the low pressure bore 23, slightly beyond the plane passing through the centers of the trunions of the two gears 20 and 21. A throttle bore 27 extends from the inner end of bore 26 and opens at the region of the side face of the bearing body 17 directed toward the gears at which the gear teeth move away from each other so that the interstices between engaging teeth increase.

If the gears rotate in the direction indicated by the arrows in FIG. 1, they will suck pressure fluid through the low pressure bore 23 into the interior of the housing and pass, in a well known manner, such pressure fluid to the high pressure bore 22 from where the pressure fluid is delivered to a non-illustrated consumer device. High pressure will therefore also prevail in the control grooves 24 and 25. Such high pressure may thus pass through the bore 26 and the throttle bore 27 to the region of the gears 20 and 21 in which the teeth thereof move away from each other, that is in which the volume of the interstices between engaging gear teeth will increase. In this way a small amount of pressure fluid may flow from the high pressure side into the enlarging interstices between engaging gear teeth, whereby creation of underpressure and cavitation is prevented. At the same time the noise during operation of the machine is essentially reduced.

Figure 7:
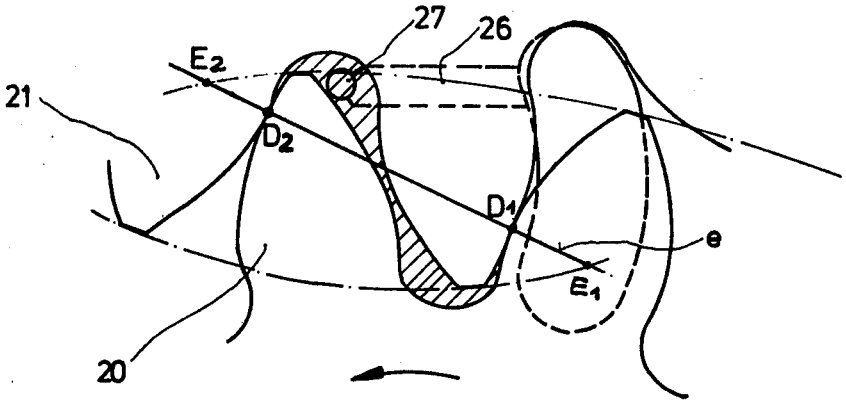
FIGS. 7 and 8 illustrate details of the embodiment shown in FIG. 1.

As shown in FIG. 7, the increasing interstices between engaging gear teeth, shown for clarity reason hatched in FIG. 7, is closed toward the suction, respectively the pressure side by the points or lines $D_1$ and $D_2$, which points move during rotation of the gears along the line *e*. If the flanks of the gears engage without play, then the corresponding sealing points are $D'_1$ and $D'_2$, as shown in FIG. 8. As further shown in FIG. 7 the end of the bore communicating with the aforementioned interstices between the engaging teeth is located radially outside of the root circle of the gear 21 but also in such a way that it can just be covered by the tip of a tooth of the gear 20.

In order to avoid unnecessary fluid pressure losses, the mouth of the throttle bore is positioned in such a way that, during the opening of the interstices between two engaging gear teeth at the end $E_2$ of the teeth engagement, the throttle bore 17 is just covered by a tooth of the gear 21 or 20. In this way passage of pressure fluid from the high pressure side into the mentioned interstices is prevented. As shown in FIG. 1, the mouth of the throttle bore 27 is located slightly towards the left of the engaging plane between the two bearing bodies 16 and 17.

Figure 4:
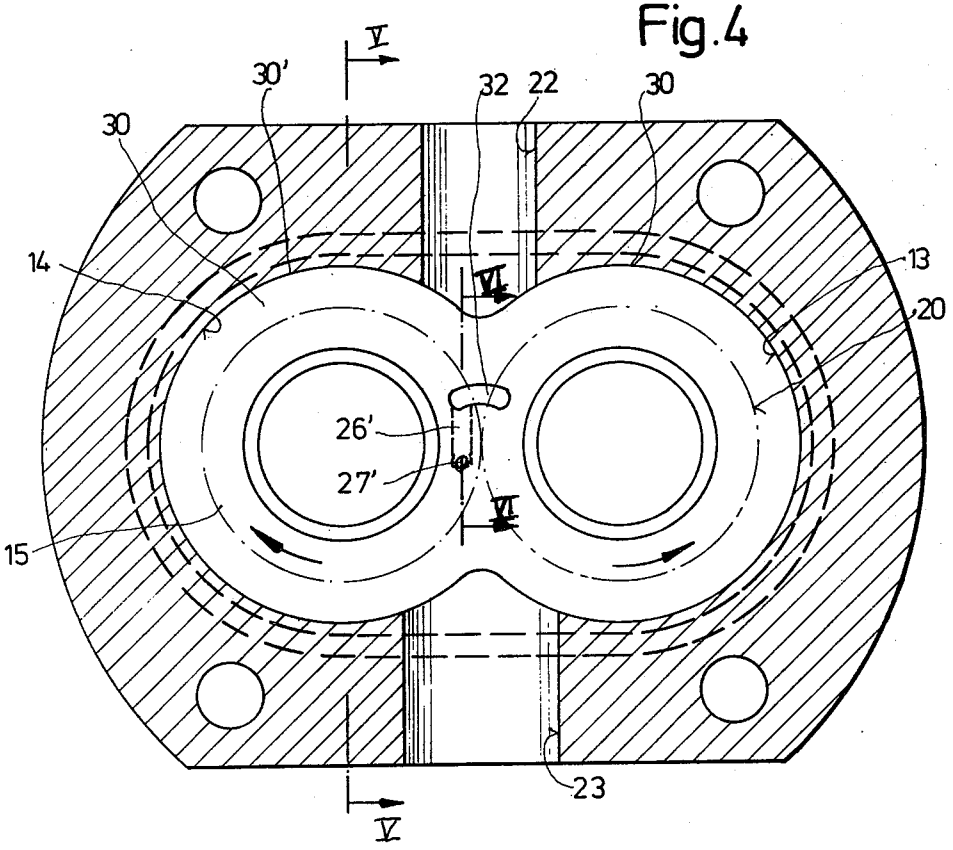
FIG. 4 is a cross-section through a second embodiment of a gear pump according to the present invention.
Figure 5:
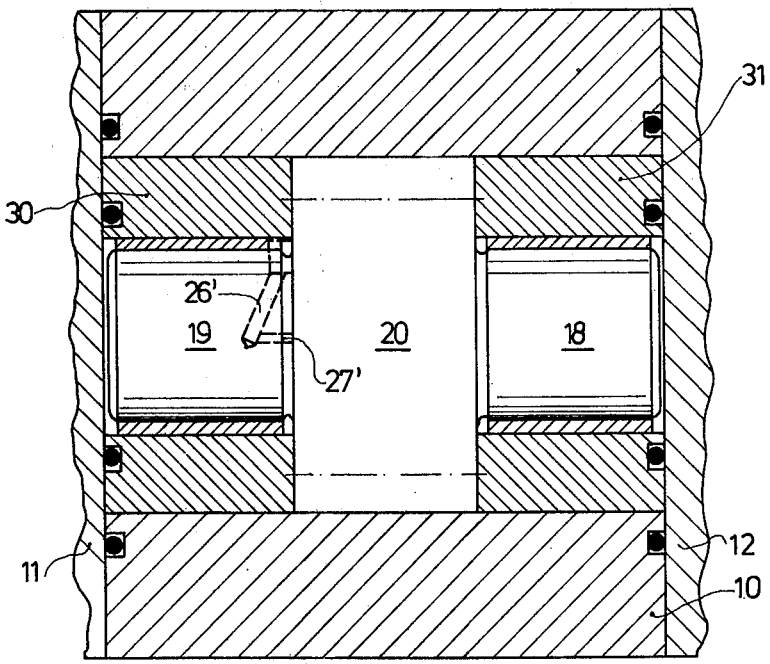
FIG. 5 is a cross-section taken along the line V—V of FIG. 4.

The embodiment illustrated in FIGS. 4 and 5 differs from the above-described embodiments in that in this embodiment the bushing shaped bearing bodies 16 and 17 are replaced by a one-piece bearing body 30 which is substantially in the form of a spectacle frame. A corresponding one-piece bearing body 31 is located at the opposite side of the gears 20 and 21. Instead of the control grooves 24 and 25 shown in the embodiment of FIGS. 1 and 2, a substantially kidney-shaped groove 32 is provided in the embodiment shown in FIGS. 4 and 5 which is located between the inner end of the high pressure bore 22 and a plane connecting the centers of the trunions of the two gears 20 and 21. A bore 26' with a throttle bore 27' leads again from the kidney-shaped groove 32 to the region in which the interstices between the engaging gear teeth increase during rotation of the gear. The kidney-shaped groove 32 is located in a region in which high pressure prevails so that the same action, as described above in connection with the embodiment shown in FIGS. 1 and 2, will occur with the embodiment shown in FIGS. 4 and 5.

Figure 6:
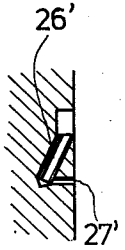
FIG. 6 is a partial cross-section taken along the line VI—VI of FIG. 4.
Figure 9:
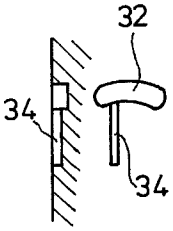
FIG. 9 is a modification of the embodiment shown in FIG. 4.

FIG. 9 shows a modification of the arrangement illustrated in FIGS. 4–6 in which the throttle passage is formed as a groove 34 with a throttling cross-section. This groove extends in the same direction as the bore 26' and ends in the region in which the interstices between the engaging gears increase. The groove 34 is formed on the side face of the bearing body which is directed towards the corresponding side face of the respective gear.

It will be understood that each of the elements described above, or two or more together, may also find a useful appliation in other types of gear pumps or motors differing from the types described above.

While the invention has been illustrated and described as embodied in a gear pump or gear motor, it is not intended to be limited to the details shown, since various modifications and structural changes may be made without departing in any way from the spirit of the present invention.

It is also possible according to the present invention that a throttle passage may also be arranged on opposite sides of the gears and even on opposite sides of the symmetry or engaging plane of the bearing bodies. Essentially is only that the throttling connection leads from the high pressure side of the machine to the mentioned region.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gear pump or motor comprising a housing having a chamber bounded by a circumferential wall and two opposite end walls; a high pressure channel extending through said circumferential wall and having an inner end communicating with said chamber; a low pressure channel extending opposite said high pressure channel through said circumferential wall and likewise communicating at an inner end with said chamber; a pair of meshing external gears mounted in said chamber for rotation about axially parallel shafts, each of said gears having two opposite axial end faces, the flanks of the gear teeth of the two gears engaging each other between the inner ends of said channels along lines and forming between the engaging lines interstices increasing in the region of the inner end of said low pressure channel and decreasing in the region of the inner end of said high pressure channel; means mounting said shafts for rotation and engaging said opposite end faces of said gears; and a throttle passage in one of said mounting means having an inlet end in a region of said chamber which is under high pressure and an outlet end in the region of an interstice increasing in volume during rotation of the gears and which is sealed off by the engaging flanks from said high and low pressure channels.

2. A gear pump or motor as defined in claim 1, wherein the throttle passage is in the form of a bore with a region of reduced cross-section at said outlet end.

3. A gear pump or motor as defined in claim 1, wherein said throttle passage is a groove in one of said mounting means, said groove having an open side facing one of said end faces.

4. A gear pump or motor as defined in claim 1, wherein said throttle passage comprises two bore portions, one of which is formed as a throttle bore and having an outlet end in the region of said increasing interstice.

5. A gear pump or motor as defined in claim 1, wherein said means mounting said shafts comprise bearing bodies in said chamber between said end walls and said axial end faces of the gears, said throttle passage being formed in at least one of said bearing bodies.

6. A gear pump or motor as defined in claim 1, and including a substantially kidney-shaped groove formed in said mounting means and having an open side facing said gears, said groove being located between a plane including the axes of both gears and said inner end of said high pressure channel, said inlet end of said throttle passage communicating with said groove.

7. A gear pump or motor as defined in claim 1, wherein the outlet end of said throttle passage is located laterally of a plane which is equidistant from the gear axes and normal to a plane including the gear axes.

8. A gear pump or motor as defined in claim 1, wherein the outlet end of said throttle passage is located inwardly of the maximum diameter of the gears.

9. A gear pump or motor as defined in claim 1, and including a control groove communicating at one end with said high pressure channel, said inlet end of said throttle passage communicating with the other end of said control groove.

10. A gear pump or motor as defined in claim 9, wherein said control groove has an open side forming facing and overlapping part of side faces of both gears.

* * * * *